United States Patent [19]

Gotchel et al.

[11] 4,004,323

[45] Jan. 25, 1977

[54] METHOD OF FORMING A NONWOVEN FIBROUS WEB

[75] Inventors: Joel Peter Gotchel, Philadelphia, Pa.; Henry James Norton, Wilmington, Del.; Aris Constantine Spengos, Wallingford; Lawrence Vaalburg, Brookhaven, both of Pa.

[73] Assignee: Scott Paper Company, Philadelphia, Pa.

[22] Filed: Apr. 10, 1975

[21] Appl. No.: 566,923

[52] U.S. Cl. ..... 19/156.3; 19/89

[51] Int. Cl.[2] ..... D01G 25/00; D04H 1/72

[58] Field of Search ..... 19/88, 89, 156–156.4, 19/155; 156/62.2, 62.4, 62.8, 63; 425/80, 81, 82, 83, 85

[56] References Cited

UNITED STATES PATENTS

| | | | |
|---|---|---|---|
| 476,710 | 6/1892 | Wherry et al. | 19/156.1 |
| 2,451,915 | 10/1948 | Burgsh | 19/89 |
| 2,897,874 | 8/1959 | Stalego et al. | 156/62.2 X |
| 3,150,215 | 9/1964 | Houghton | 425/82 X |
| 3,797,074 | 3/1974 | Zafiroglu | 19/156.3 |
| 3,862,472 | 1/1975 | Norton | 19/156.3 |

FOREIGN PATENTS OR APPLICATIONS

| | | | |
|---|---|---|---|
| 320,518 | 10/1929 | United Kingdom | 19/89 |

*Primary Examiner*—Dorsey Newton
*Attorney, Agent, or Firm*—Martin L. Faigus; William J. Foley

[57] ABSTRACT

The invention resides in a method of forming a nonwoven web by employing a forming apparatus which includes a fiberizing roll for separating fibers from a feed mat and entraining them in a gaseous medium, a foraminous forming surface through which the gaseous medium passes and upon which the fibers are condensed to form a fibrous web, and a formation duct between the fiberizing roll and the forming surface for defining a flow path for the gaseous suspension of fibers from the fiberizing roll to the forming surface; the improvement wherein the formation duct includes front and back, substantially planar inner surfaces which may slightly converge in a direction from the fiberizing roll to the forming surface, but preferably diverge at an angle of up to about 4½ degrees when the forming surface is a curved surface of a cylindrical drum, and up to about 1½ degrees when the forming surface is a linear surface of a forming belt; the formation duct being inclined to the forming surface to define an incidence angle with the forming surface in the range of from about 10° to about 30°. The invention also resides in a method of forming a nonwoven web by employing the above-described apparatus.

10 Claims, 2 Drawing Figures

METHOD OF FORMING A NONWOVEN FIBROUS WEB

BACKGROUND OF THE INVENTION

1. Field of the Invention

This invention relates to method and apparatus for forming fibrous webs from a gaseous suspension of fibers, and more specifically to an improvement in such method and apparatus for achieving high speed, high quality formation of nonwoven fibrous webs.

2. Description of the Prior Art

Air-laid fibrous webs are becoming extremely popular for use in disposable products, such as disposable diapers, sanitary napkins, cosmetic pads, industrial towels, household towels, tissues and the like. These products are generally intended for single, or limited use applications, and accordingly, it is important that they be capable of fabrication in an economical manner. One of the most significant problems encountered in the fabrication of air-laid fibrous webs has been to achieve high speed, high quality production so as to minimize manufacturing costs.

A commonly employed apparatus for forming an air-laid fibrous web includes a fiberizing roll for separating fibers from a fibrous feed mat and entraining the fibers in air to form an air suspension of said fibers. The air suspension of fibers is directed through an upstream end of a formation duct toward a moving foraminous forming surface which traverses a downstream open end of said duct. The air from the suspension is directed through the foraminous forming surface, and the fibers from the suspension are condensed upon the forming surface to form the air-laid fibrous web. A partial vacuum is established behind the forming surface to aid in directing the air suspension of fibers toward it. Quite often the formed webs are subjected to conventional post-treatment operations; such as embossing, adhesive bonding, and the like; to impart desired properties to the webs.

The above-described apparatus has a web formation area on the foraminous forming surface bound by the walls of the formation duct. It is known that a large formation area is desirable to minimize the pressure drop through the foraminous forming surface. It is suggested in U.S. Pat. No. 2,703,441, issued to Langdon et al., to increase the formation area on a forming surface by inclining the forming surface diagonally to the central axis of a formation duct, and by establishing a relatively large divergence angle between front and back inner surfaces of said formation duct. Applicants have found that such an arrangement can not be employed to achieve high quality, air-laid web formation at high production speeds, i.e. over 200 feet per minute. Specifically, the geometry of the Langdon et. al. device creates air-flow instabilities in the gaseous suspension, and at high production speeds these instabilities create fiber clumps and excessive basis weight variations throughout the web. In fact, in some instances holes may actually be formed in the web.

British Patent Specification No. 883,139, discloses an apparatus for manufacturing a textile fiber web. The apparatus includes a fiberizing roll for separating fibers from a feed mat and directing the fibers in a gaseous suspension through a formation duct to a foraminous, cylindrical forming surface upon which the web is formed. In that apparatus it is required that the machine casing conform in shape to the periphery of the fiberizing roll so that the duct area between the stripping point on the fiberizing roll and the cylindrical condenser be substantially uniform or gradually increasing. Although such an arrangement allegedly will minimize the creation of undesirable eddies, or pressure variations in the air stream, the British specification is silent as to other parameters which applicants have found to be extremely important to their invention. Specifically, the British specification does not disclose any criticality in the particular angle of incidence between the formation duct and the forming surface, nor any specific critical relationship between the angle of incidence and the included angle between front and back inner surfaces of the formation duct. These parameters have been found, in the instant invention, to be critical to the high speed, high quality formation of air-laid fibrous webs.

Moreover, the arrangement of the air-conveying ducts in the apparatus disclosed in the British specification precludes high speed operation to produce high quality fibrous webs. Specifically, at high production speeds a high velocity air flow must be directed into the upstream end of the fiberizing zone to establish the fiber path depicted in FIG. 1. Since the opening into the upstream end of the fiberizing zone is large, a large volume of air is required to establish this high velocity flow. Accordingly, a high vacuum level would also have to be established behind the forming surface to remove the large volume of air directed into the fiberizing zone. The use of a high vacuum level can cause the fibers deposited on the forming surface to become excessively stapled to the forming surface; thereby causing the web to become damaged as it is removed therefrom.

Several different embodiments of air-laydown apparatus are disclosed in U.S. Pat. No. 3,797,074, issued to Zafiroglu. In all embodiments a formation duct is disposed between a fiberizing roll and a foraminous surface upon which a web of staple-length fibers is formed. The formation duct is oriented to the foraminous surface at either about 90° or at 45°, and absolutely no criticality is alleged, or suggested, as to the desired orientation of the formation duct with the foraminous surface. In fact, the orientations disclosed in the Zafiroglu patent are not within the critical range of applicant's invention.

SUMMARY OF THE INVENTION

Apparatus and method of this invention employ a unique geometric relationship of elements for permitting the formation of high quality, air-laid fibrous webs at web forming speeds in excess of 200 feet per minute. The quality of an air-laid fibrous web is determined by its freeness from fiber clumps, and its uniformity of basis weight.

Apparatus of this invention include a fiberizing roll for separating fibers from a feed mat, web or lap and entraining the fibers in a gaseous medium, a foraminous forming surface positioned downstream of the fiberizing roll through which the gaseous medium passes and upon which the fibers are condensed to form a fibrous web, and a formation duct establishing a flow path for the air suspension of fibers between the fiberizing roll the forming surface. The formation duct includes front and back plates having substantially planar inner surfaces which may slightly converge in a direction from the fiberizing roll to the forming surface, but preferably diverge at an angle of up to about 4 ½ degrees when the forming surface is a curved surface of a cylindrical drum, and up to about 1 ½ degrees when the forming surface is a linear surface of a belt; the formation duct being inclined to the forming surface at an incidence angle in the range of from about 10° to about 30°.

Reference to "incidence angle" throughout this application refers to the acute angle between the central plane of the formation duct and a tangent to the forming surface at the location where the central plane intercepts the forming surface.

Applicants have found that when the incidence angle is less than about 10 degrees high quality web formation can not be achieved at high web forming speeds in excess of 200 feet per minute. Specifically, at these high web forming speeds the fibers tend to roll, or slide along the forming surface to create a nonuniform basis weight structure. Moreover, at angles exceeding about 30°, the web quality achieved at high formation speeds begins to significantly decrease; however, the reason for this latter phenomenon is not understood.

The problem of fiber rolling, or sliding is most prevalent at the upstream section of the web formation area, i.e. the section between the back plate and central axis of the formation duct. When a curved forming surface (e.g. the outer surface of a forming drum) is employed, the acute angle between the central plane of the formation duct and a tangent to the forming surface at all locations in the upstream section of the web formation area is greater than the incidence angle, and gradually decreases from the back plate to the central plane. This latter relationship permits the use of a larger duct divergence angle when a curved forming surface is employed than when a linear forming surface is employed, without creating a fiber sliding problem. This larger divergence angle increases the web forming area to thereby reduce the pressure drop through the forming surface. Preferably, the front plate is oriented along a line substantially tangent to the outer periphery of the curved forming surface, and can even be oriented to extend slightly outside the tangent line to create a gap between the front plate and the periphery of the forming roll to further increase the forming area.

Other objects and advantages of this invention will become apparent upon reading the detailed description which follows, taken in conjunction with the drawings.

DESCRIPTION OF THE PREFERRED EMBODIMENTS OF THIS INVENTION

Figure 1:
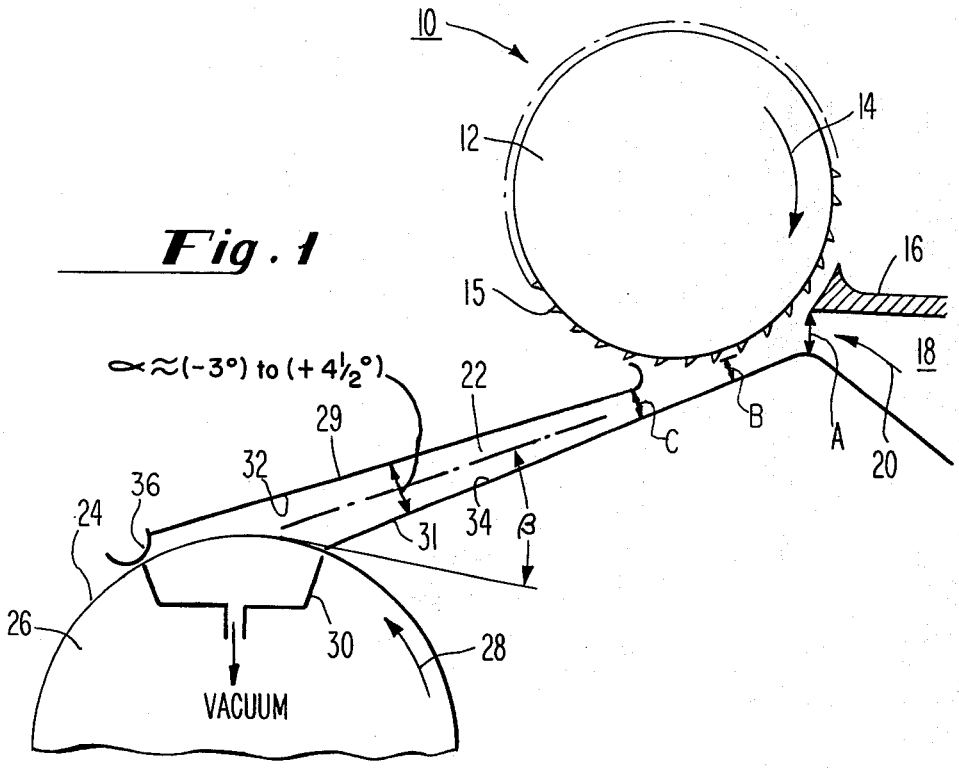
FIG. 1 is a schematic view of an air-laydown apparatus according to one embodiment of this invention.

Referring to FIG. 1, a first embodiment of an air-laydown apparatus 10 of this invention includes a fiberizing roll 12 that is positively driven by any suitable drive means (not shown) in the direction indicated by arrow 14. The fiberizing roll 12 includes pins or teeth 15 on the outer surface thereof. In a preferred embodiment of this invention the fiberizing roll 12 is a conventional lickerin roll of the type employed in the Rando-Webber, which is manufactured by Rando Machine Corporation of Rochester, New York. A fibrous feed mat (not shown) is directed over a supporting surface 16 into engagement with the rotating fiberizing roll 12. The fibers are separated from the feed mat by the fiberizing roll and are suspended in an air stream which enters the fiberizing zone through an air inlet duct 18 in the direction indicated by arrow 20. If desired, the high pressure side of a fan (not shown) can be connected to the air inlet duct 18 for directing the air stream into the fiberizing zone. The air-suspended stream of fibers is directed through a formation duct 22 toward a foraminous outer surface 24 of a cylindrical forming drum 26. The forming drum is positively driven in the direction of arrow 28 by any suitable drive means (not shown).

Movement of the air suspended stream of fibers toward the foraminous forming surface 24 is enhanced by establishing a partial vacuum through a vacuum box 30 which is positioned beneath the foraminous surface in underlying relationship with the open end of the formation duct 22. The partial vacuum is established by connecting the vacuum box 30 to the low pressure side of fan (not shown) and this partial vacuum can be employed to draw air into the fiberizing zone through the air inlet duct 18. The fibers in the stream are deposited on the foraminous forming surface 24 in the web formation area of the apparatus 10 to form a nonwoven web of randomly arranged and intermingled fibers.

The nonwoven webs formed in accordance with this invention can be of any desired fiber composition. For example, the webs can be formed of 100% short cellulosic fibers of a papermaking length less than ¼ inch, 100% of longer staplelength fibers, or blends of such short and longer fibers. Also, the basis weight of such webs can be varied over a wide range.

In accordance with a preferred form of this invention nonwoven webs having a low basis weight in the range of from about 1 oz./yd.$^2$ to about 6 oz./yd.$^2$ are formed from a fiber blend comprising a preponderance, by weight, of short cellulosic fibers of a papermaking length less than ¼ inch (e.g. wood pulp fibers and cotton linters) and a minor amount of longer reinforcing fibers (e.g. rayon and polyester). A nonwoven web as described above can be formed by any conventional processing sequence; a preferred sequence being disclosed in U.S. Pat. No. 3,862,472 titled "Method For Forming A Low Basis Weight Non-Woven Fiberous Web", issued on Jan. 28, 1975, and assigned to Scott Paper Company. The subject matter of that patent is incorporated by reference into the instant application.

Referring again to FIG. 1, the formation duct 22 includes front and back plates 29 and 31 having substantially planar inner surfaces 32 and 34, respectively. These inner surfaces may slightly converge in a direction from the fiberizing roll to the forming surface, but preferably diverge at an angle *a* of up to about 4 ½ degrees. The degree of convergence which can be tolerated depends upon the required, or desired web forming area, and generally will be less than about 3 degrees. Preferably the inner surfaces 32 and 34 diverge at an angle of from about 1° to about 4 ½°, and most preferably diverge at an angle of about 2 ½°. The incidence angle B of the formation duct 22 with the forming surface 24 is in the range of from about 10° to about 30°. More preferably the incidence angle is in the range of from about 15° to about 25°, and most preferably the incidence angle is about 20°. As explained earlier the "incidence angle" is the acute angle between the central plane of the formation duct 22 and a line which is tangent to the foraminous forming surface 24 at the location where the central plane of said formation duct intercepts the forming surface.

The formation duct is closed at its side margins by side plates (not shown). These side plates preferably have substantially planar inner surfaces which are parallel to each other; however, a slight convergence or divergence of the side plates can be tolerated without creating excessive flow instabilities.

Applicants have found that the above-described orientation of the front and back inner surfaces 32 and 34, in conjunction with the particular duct orientation relative to the forming surface, provides for high quality formation of nonwoven fibrous webs at web forming speeds in excess of 200 feet per minute. In fact, applicants have achieved excellent results at web forming speeds in excess of 400 feet per minute. Prior to the instant invention commercial web forming equipment, to the best of applicants knowledge, could not be employed to form similar quality nonwoven webs at the speeds which can be employed with the apparatus 10 of this invention.

Applicants have found that inclining the formation duct 22 at an incidence angle of less than 10° causes fibers which initially impinge upon the forming surface 24 at the upstream end of the formation area to slide thereon during high speed operation of the apparatus 10. This sliding action causes a nonuniform basis weight distribution and clumping of fibers within the web. Applicants have also found that as the angle of inclination increases to above about 30° the web quality diminishes considerably; however, the reason for this diminution in quality is not understood.

Applicants have also discovered that in order to obtain the benefit of uniform web formation by inclining the formation duct to the forming surface within the incidence angle ranges described above, the angle between the front and back surfaces 32 and 34 of the formation duct 22 should diverge no more than about 4 ½°. At larger included angles of more than about 4 ½°, air flow instabilities occur in the formation duct, and these instabilities cause poor quality web formation.

An additional feature of this invention resides in the manner in which air is directed into the region of the fiberizing roll 12 through the air inlet duct 18. Specifically, for high formation speeds in excess of 200 feet/minute the depth "A" adjacent the downstream open end of duct 18 should be small to permit establishing the requisite high velocity air flow therethrough, without requiring the use of excessively large volumes of air. Preferably the depth A should be no greater than about twice the depth B at the location at which fibers are diverted from the fiberizing roll. The latter location is approximately where the outer periphery of the fiberizing roll most closely approaches an extended section of the bottom wall 31 of the formation duct.

Uniformity of web formation is enhanced by providing substantially uniform flow of the gaseous suspension of fibers from the fiberizing roll to the forming surface. Uniform flow is enhanced by establishing a low ratio between the depth C at the upstream end of the formation duct and the depth B at the location at which fibers are diverted from the fiberizing roll toward the formation duct. Preferably the ratio, C/B, is less than about 4, and most preferably less than about 2.

Figure 2:
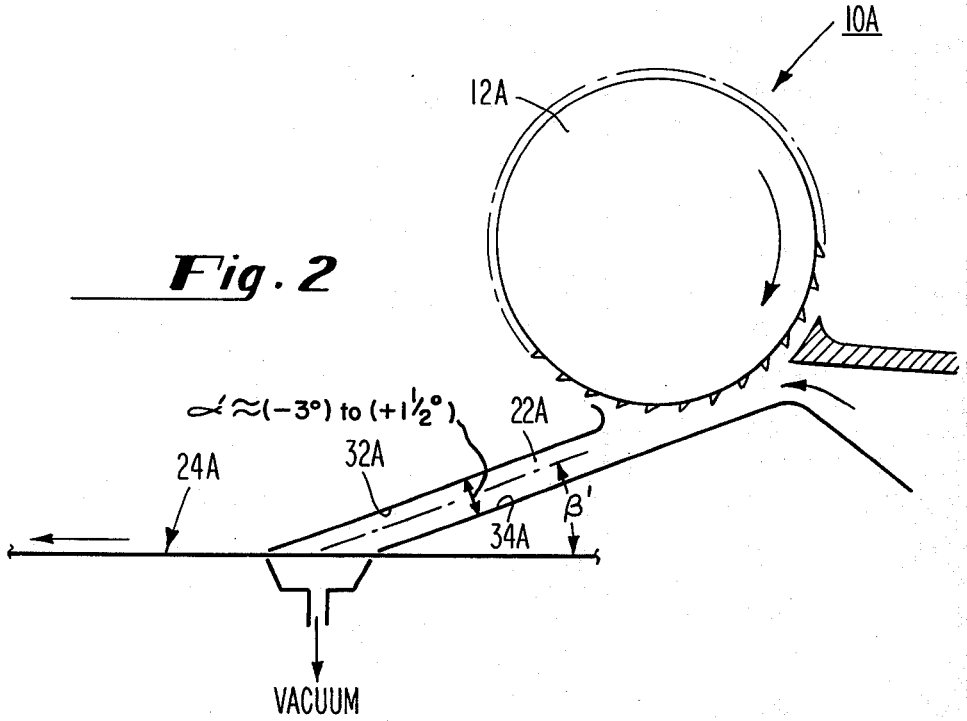
FIG. 2 is a schematic view of an air-laydown apparatus according to a second embodiment of this invention.

Referring to FIG. 2, a second embodiment of an apparatus 10A is shown in which a foraminous forming surface 24A is a substantially linear run of a continuous forming belt. In this embodiment optimum results also are achieved by establishing an angle of incidence B between a formation duct 22A and the foraminous forming surface 24A in the range of from about 10° to about 30°; preferably from about 15° to about 25 degrees, and most preferably about 20 degrees. The angle *a* between front and back, substantially planar inner surfaces 32A and 34A of formation duct 22A, in the direction from fiberizing roll 12A to the foraminous forming surface 24A, should preferably be no greater than about 1 ½ degrees, and most preferably the inner surfaces 32A and 34A should be parallel to each other (i.e., provide an included angle of 0°. Alternatively, the inner surfaces 32A and 3A may converge toward each other in the same manner as described earlier in connection with FIG. 1. Excellent results have been achieved with the inner surfaces 32A and 34A parallel to each other, and the formation duct 22A having an angle of incidence B with the forming surface 24A of about 20°. In all other respects the apparatus 10A shown in FIG. 2 is the same as the apparatus 10 described above in connection with FIG. 1.

The problem of fiber rolling, or sliding is most prevalent in the upstream section of the web formation area, i.e. the section between the back plate 31 and the central plane of the formation duct. When a curved forming surface (e.g. the outer surface of a forming drum) is employed the acute angle between the central plane of the formation duct and a tangent to the forming surface at all locations in the upstream section of the web formation area is greater than the incidence angle, and gradually decreases in a direction from the back plate to the central plane. This latter relationship permits the use of a larger duct divergence angle when a curved forming surface is employed than when a linear forming surface is employed, without creating a fiber sliding problem. This greater included angle increases the web forming area to reduce the pressure drop through the forming surface. The included angle can be increased by orienting the front plate 29 along a line substantially tangent to the outer periphery of the curved forming surface, and preferably by orienting the front plate to extend outwardly of the tangent line to provide a gap between the front plate and the forming surface. This latter arrangement is shown in FIG. 1. Preferably a seal member 36 is attached to the downstream end of the front plate 29 and engages the forming surface 24 for preventing fibers from being blown out of the gap. The seal member 36 should be resilient, or movable mounted to the front plate so that said member can be biased away from the forming surface by a formed web which is directed out of the formation area.

Having described our invention we claim:

1. A method for forming a nonwoven fibrous web at a speed in excess of 200 ft./minute and in a basis weight range of from about 1 oz./yd.$^2$ to about 6 oz./yd.$^2$, said web including at least a preponderance by weight of short cellulosic fibers of a papermaking length less than ¼ inch, said method comprising the steps of:

A. separating fibers from a feed mat which includes at least a preponderance by weight of short cellulosic fibers of a papermaking length less than ¼ inch and entraining said fibers in a gaseous medium to form a gaseous suspension of fibers;

B. conveying the gaseous suspension of fibers in a stream to a convex forming surface while confining said stream by substantially flat front, back and side inner surfaces of a duct that is disposed at an incidence angle to said forming surface in the range of from about 10° to about 30°, and in which the front and back inner surfaces, in a direction toward the foraminous forming surface, provide an included angle in the range of less than about 3° convergence up to about 4½° divergence;

C. moving the convex forming surface at a speed in excess of 200 ft./minute; and D. continuing to confine said stream by inner surfaces of the duct while depositing the fibers from the suspension onto the moving forming surface in the form of a nonwoven fibrous web having a basis weight in the range of from about 1 oz./yd.$^2$ to about 6 oz./yd.$^2$.

2. The method according to claim 1, wherein the step of separating fibers from the feed mat is accomplished by separating fibers from a feed mat including a preponderance by weight of short cellulosic fibers of a papermaking length less than ¼ inch and a minor amount of longer reenforcing fibers, whereby the nonwoven web which is formed is a blend of such short and longer fibers.

3. The method according to claim 1, including the step of establishing a pressure drop across the convex forming surface in underlying relationship with the fibrous stream for aiding in directing said stream toward said forming surface, said pressure drop being effective to withdraw the gas of the stream through the forming surface and to deposit the fibers from the stream onto said forming surface to form the nonwoven fibrous web.

4. The method according to claim 3, wherein the included angle which is established between the opposed upper and lower surfaces of the stream is in the range of from about 1° to about 4¼°.

5. The method according to claim 4, including conveying the gaseous stream to the forming surface at an incidence angle in the range of from about 15° to about 25°.

6. A method for forming a nonwoven fibrous web at a speed in excess of 200 ft./minute and in a basis weight range of from about 1 oz./yd.$^2$ to about 6 oz./yd.$^2$, said web including at least a preponderance by weight of short cellulosic fibers of a papermaking length less than ¼ inch, said method comprising the steps of:

A. separating fibers from a feed mat which includes at least a preponderance by weight of short cellulosic fibers of a papermaking length less than ¼ inch, and entraining said fibers in a gaseous medium to form a gaseous suspension of fibers;

B. conveying the gaseous suspension of fibers in a stream to a linear forming surface while confining said stream by substantially flat front, back and side inner surfaces of a duct that is disposed at an incidence angle to said forming surface in the range of from about 10° to about 30°, and in which the front and back inner surfaces, in a direction toward the foraminous forming surface, provide an included angle in the range of less than about 3½° convergence up to about 1½° divergence;

C. moving the linear forming surface at a speed in excess of 200 ft./minute; and D. continuing to confine said stream by inner surfaces of the duct while depositing the fibers from the suspension onto the moving forming surface in the form of a nonwoven fibrous web having a basis weight in the range of from about 1 oz./yd.$^2$ to about 6 oz./yd.$^2$.

7. The method according to claim 6, including the step of establishing a pressure drop across the linear forming surface in underlying relationship with the fibrous stream for aiding in directing said stream toward said forming surface, said pressure drop being effective to withdraw the gas of the stream through the forming surface and to deposit the fibers from the stream onto said forming surface to form the nonwoven fibrous web.

8. The method according to claim 7, wherein the step of separating fibers from the feed mat is accomplished by separating fibers from a feed mat including a preponderance be weight of short cellulosic fibers of a papermaking length less than ¼ inch and minor amount of longer reenforcing fibers, whereby the nonwoven web which is formed is a blend of such short and long fibers.

9. The method according to claim 7, including establishing an included angle between the upper and lower surfaces of the stream in the range of from about 0° to about 1-½°.

10. The method according to claim 9, including conveying the gaseous stream to the forming surface at an incidence angle in the range of from about 15° to about 25°.

* * * * *